US006186499B1

(12) United States Patent
Gross

(10) Patent No.: US 6,186,499 B1
(45) Date of Patent: Feb. 13, 2001

(54) SHEET GRIPPER IN A SHEET-FED ROTARY PRINTING PRESS

(75) Inventor: Manfred Gross, Dossenheim (DE)

(73) Assignee: Heidelberger Druckmaschinen Aktiengesellschaft, Heidelberg (DE)

( * ) Notice: Under 35 U.S.C. 154(b), the term of this patent shall be extended for 0 days.

(21) Appl. No.: 09/135,924

(22) Filed: Aug. 18, 1998

(30) Foreign Application Priority Data

Aug. 18, 1997 (DE) ..... 197 35 766

(51) Int. Cl.[7] ..... B65H 29/06
(52) U.S. Cl. ..... 271/277; 271/82; 101/409
(58) Field of Search ..... 271/277, 82; 101/408, 101/409, 410

(56) References Cited

U.S. PATENT DOCUMENTS 4,716,828 * 1/1988 Hartung et al. ..... 271/277
4,719,854 1/1988 Ruger et al. .
4,947,748 * 8/1990 Hiltwein et al. ..... 101/409
5,128,726 * 7/1992 Cassano et al. ..... 271/277
5,199,757 * 4/1993 Simeth ..... 271/82
5,390,600 * 2/1995 Thunker ..... 271/277
5,542,657 * 8/1996 Kemmerer et al. ..... 271/82

FOREIGN PATENT DOCUMENTS 356 241 7/1922 (DE) .
670 298 1/1939 (DE) .
1 761 308 5/1971 (DE) .

* cited by examiner

*Primary Examiner*—H. Grant Skaggs
(74) *Attorney, Agent, or Firm*—Herbert L. Lerner; Laurence A. Greenberg; Werner H. Stemer

(57) ABSTRACT

A sheet gripper in a sheet-fed rotary printing press, having a pivotally supported gripper shaft, whereon a gripper element cooperatable with a gripper pad is pivotally disposed and a clamping element is fixedly disposed, includes a spring element for placing the gripper element and the clamping element into operative contact, the spring element being formed as a leaf spring.

11 Claims, 1 Drawing Sheet

Fig. 1
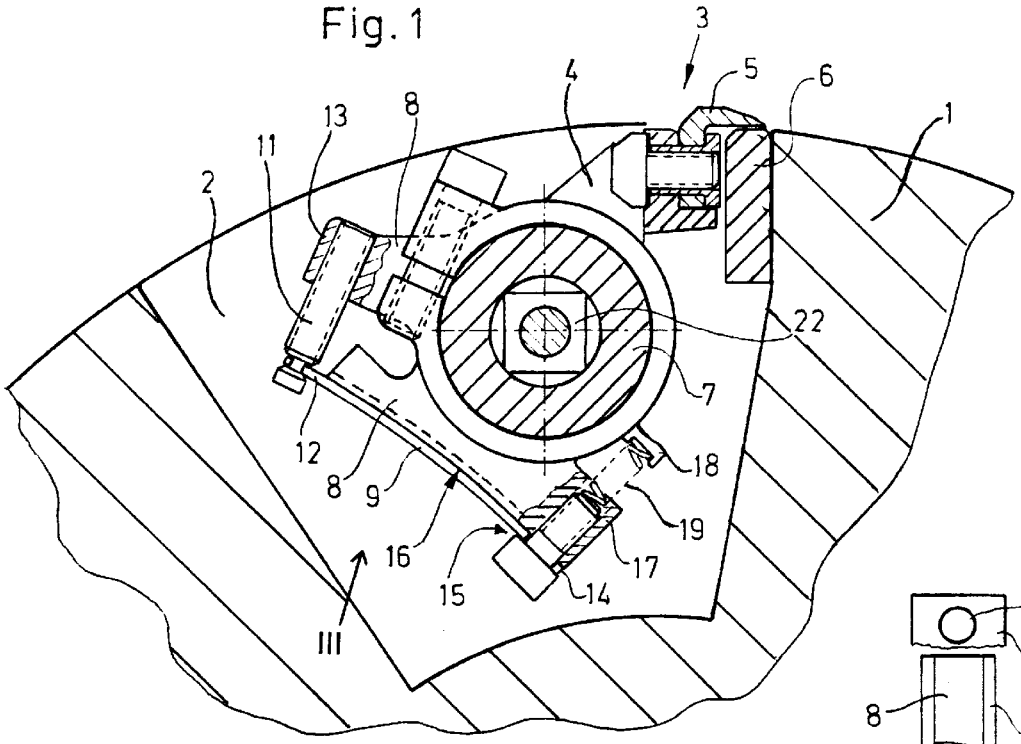
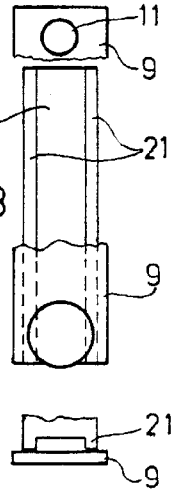
Fig.3
Fig. 2
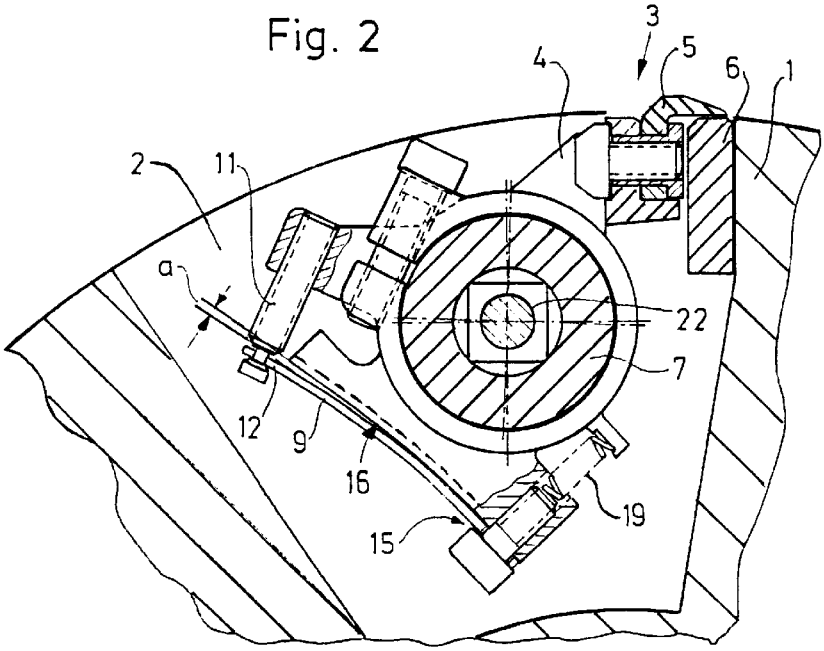

SHEET GRIPPER IN A SHEET-FED ROTARY PRINTING PRESS

BACKGROUND OF THE INVENTION

FIELD OF THE INVENTION

The invention relates to a sheet gripper in a sheet-fed rotary printing press, wherein a spring applies a holding force between gripper fingers and a gripper pad of the sheet gripper.

A sheet gripper of this general type has become known heretofore from U.S. Pat. No. 4,947,748 wherein there is shown and described a sheet gripper element or finger cooperating with a gripper pad. The gripper element is pivotally supported by a gripper housing therefor on a likewise pivotable shaft. In the immediate vicinity of the gripper element, a counteracting stop is secured to the shaft and is operatively connected to the gripper housing by a compression spring. The compression spring is disposed in prestressed condition between the gripper housing and the counteracting stop, so that when the gripper element meets the gripper stop, the full force of the prestressed compression spring comes into effect.

An impact resulting from this encounter can cause the gripper element to spring back from the gripper pad when processing speeds are high, thereby impairing a true-register holding or retention of the sheet that is to be transported. Furthermore, the cylinder carrying the sheet gripper is excited to vibrate.

SUMMARY OF THE INVENTION

It is accordingly an object of the invention to provide a sheet gripper in a rotary printing press wherein excitation of vibrations is minimized.

With the foregoing and other objects in view, there is provided, in accordance with the invention, a sheet gripper in a sheet-fed rotary printing press, having a pivotally supported gripper shaft, whereon a gripper element cooperatable with a gripper pad is pivotally disposed and a clamping element is fixedly disposed, comprising a spring element for placing the gripper element and the clamping element into operative contact, the spring element being formed as a leaf spring.

In accordance with another feature of the invention, the sheet gripper includes a fixed fastener disposed at one end of the leaf spring.

In accordance with a further feature of the invention, the sheet gripper includes a gripper housing for the gripper element, the other end of the leaf spring located distal from the fixed fastener being connected to the gripper housing.

In accordance with another feature of the invention, the sheet gripper includes an adjusting device for adjusting a spaced distance between the gripper element and the gripper pad, the adjusting device being disposed between the other end of the leaf spring and the gripper housing.

In accordance with an added feature of the invention, the clamping element is formed with a contact surface engageable by the leaf spring.

In accordance with an additional feature of the invention, the leaf spring is disposable so as to rest uniformly, with prestressing, on the contact surface.

In accordance with yet another feature of the invention, the contact surface is flat, and the leaf spring is curved and rests uniformly with prestressing on the flat contact surface.

In accordance with yet a further feature of the invention, the contact surface has a concave curvature, and the leaf spring has a rectilinear form.

In accordance with yet an added feature of the invention, the curvature extends in a direction from a fastening location at one end of the leaf spring to the other end of the leaf spring located distal from the one end thereof.

In accordance with still another feature of the invention, the curvature of the contact surface corresponds to a bending line assumed by a beam fixedly fastened at one end thereof, when a load distributed over the length of the beam is applied thereto.

In accordance with still a further feature of the invention, the contact surface is formed by a plurality of rails.

In accordance with still an added feature of the invention, the rails are disposed in parallel.

In accordance with still an additional feature of the invention, the sheet gripper includes a compression spring disposed between an abutment of the gripper housing and an abutment of the clamping element.

In accordance with another feature of the invention, the compression spring is slightly prestressed for eliminating bearing play between the gripper housing and the gripper shaft.

In accordance with a concomitant feature of the invention, the gripper element is disposed in a cylinder gap formed in a sheet-transport cylinder of the sheet-fed rotary printing press.

An advantage of the invention is, in particular, that both upon closing and opening of the gripper element, the intensity of impacts and shocks, which occur, for example, when, upon closing, the gripper element meets the gripper pad or, upon opening, a counterpart stop strikes an abutment of the gripper element, is minimized.

In an advantageous feature, the leaf spring according to the invention is provided with a fixed fastener at one end thereof, thereby, in conjunction with a defined contact surface, producing a degressive spring characteristic curve.

A contact surface for the relaxing leaf spring has a concave curvature. The curvature is designed so that the leaf spring rests uniformly thereon with prestressing. Under load, the leaf spring gradually lifts away from the curved contact face, so that the leaf spring has a nonlinear degressive spring characteristic curve, which makes for a gentler closing and opening of the gripper element.

In a preferred embodiment, the curvature takes the form of a bending line that a beam fixedly fastened at one end thereof assumes upon being loaded with a load distributed over the length thereof. As a result of this provision, the leaf spring, when relieved, presses gently against the contact surface until the leaf spring finally reaches a position of repose, wherein a uniform force is established between the leaf spring and the contact surface.

To minimize soiling between the contact surface and the leaf spring, the contact surface is formed of a plurality of narrow rails, spaced apart from one another, which are preferably disposed parallel to one another.

Other features which are considered as characteristic for the invention are set forth in the appended claims.

Although the invention is illustrated and described herein as embodied in a sheet gripper in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 1 is a fragmentary, diagrammatic cross-sectional view of a sheet gripper device according to the invention having a gripper element disposed in a force-free closed position thereof relative to a gripper pad;

FIG. 2 is a view like that of FIG. 1 showing the sheet gripper element in a fully closed position, i.e, wherein a holding or retention force has built up between the sheet gripper element and the gripper pad; and FIG. 3 is a plan view, partly broken away, of a contact face of a clamping element according to the invention as seen in the direction of the arrow III in FIG. 1, for examples.

DESCRIPTION OF THE PREFERRED EMBODIMENTS

Referring now to the drawings and, first, particularly to FIG. 1 thereof, there is shown therein a sheet-fed rotary printing press having a sheet-transporting cylinder 1 formed with a cylinder channel or gap 2, wherein a sheet gripper device 3 driven at the operating speed of the printing press is disposed. The gripper device 3 has a gripper element 5 and a gripper pad 6 corresponding thereto. The gripper element 5 is secured to a gripper housing 4, which is pivotally driven, in accordance with a sheet processing cycle, relative to a shaft 7, whereon it is pivotally supported. In the immediate vicinity of the gripper housing 4, a clamping member 8 is secured, as a stop for the gripper housing 4, on the shaft 7.

In practice, such gripper devices are distributed over the axial length of the shaft 7. In the interest if simplicity, the description hereinbelow will refer only to a single gripper device.

The gripper housing 4 is operatively connected to the clamping element 8 by a leaf spring 9. To adjust the spacing between the gripper element 5 and the gripper pad 6, an adjusting screw 11 is provided between one end 12 of the leaf spring 9 and a projection or protrusion 13 of the gripper housing 4. At an end of the leaf spring 9 located opposite the end 12 thereof at which the adjusting screw 11 is provided, the leaf spring 9 is secured to the clamping element 8 by a fixed fastener 15. The clamping element 8, at a side thereof facing towards the leaf spring 9, is formed with a contact surface 16 for engagement by the leaf spring 9.

The contact surface 16 has a concave curvature which extends from the fixed fastener 15 for the leaf spring 9 in a direction towards the end 12 of the leaf spring 9. The curvature is designed so that it corresponds to a bending line assumed by a beam fixedly fastened at one end thereof, when a load distributed over the length of the beam is applied thereto.

In a non-illustrated second embodiment, the contact surface 16 directed towards the leaf spring 9 may be planar or flat, so that the curved leaf spring 9 engages the planar contact surface 16 with a prestressing force.

To prevent soiling between the contact surface 16 and the leaf spring 9 from having any effect upon the contact of the leaf spring 9 with the contact surface 16, the latter may be provided with a very narrow shape. In this regard, it is therefore proposed, that a plurality of rails 21 (note FIG. 3), for example, two in number, be provided, spaced apart from one another and preferably parallel to one another.

Between an abutment 17 of the clamping element 8 and an abutment 18 of the gripper housing 4, an additional compression spring 19 is provided, for forcing out or eliminating any bearing play between the gripper housing 4 and the shaft 7.

The opening and closing of the gripper element 5 is controlled in a conventional manner by a non-illustrated cam, in accordance with the operating cycle of the sheet-fed rotary printing press.

Upon closure of the gripper 5 in FIG. 1, the shaft 7 which is hollow is pivoted farther counter to the force of a torsion spring 22. The clamping element 8 connected to the shaft 7 is consequently entrained. The leaf spring 9 gradually lifts away from the contact surface 16. The contact pressure or compressive force between the gripper element 5 and the gripper pad 6 thereby rises from zero to the desired holding or retention force. A spaced distance a thereby established between the leaf spring 9 and the contact surface 16 in the vicinity of the end 12 of the spring 9 is a measure of the 20 contact pressure of the gripper element 5 against the gripper pad 6, such as F=75 N, for example.

When the gripper element 5 opens from the fully closed condition thereof shown in FIG. 2, the shaft 7 is pivoted farther back again together with the clamping element 8. In this regard, the leaf spring 9 gradually presses against the contact surface 16 again, so that the contact pressure gradually tends to zero. The instant the leaf spring a rests completely on the contact surface 16 (note FIG. 1), the gripper element 5 becomes entrained, and a receiving gap for the sheet is formed or created between the gripper element 5 and the gripper pad 6.

I claim:

1. A sheet gripper in a sheet-fed rotary printing press, having a pivotally supported gripper shaft, whereon a gripper element cooperatable with a gripper pad is pivotally disposed and a clamping element is fixedly disposed, comprising a spring element for placing the gripper element and the clamping element into operative contact, said spring element being formed as a leaf spring, the clamping element being formed with a contact surface engageable by said leaf spring, and said leaf spring being disposable so as to rest uniformly, with prestressing, on said contact surface.

2. The sheet gripper according to claim 1, wherein said contact surface is flat, and said leaf spring is curved and rests uniformly with prestressing on said flat contact surface.

3. The sheet gripper according to claim 1, wherein said contact surface has a concave curvature, and said leaf spring has a rectilinear form.

4. The sheet gripper according to claim 3, wherein said curvature extends in a direction from a fastening location at one end of said leaf spring to the other end of said leaf spring located distal from said one end thereof.

5. The sheet gripper according to claim 3, wherein said curvature of said contact surface corresponds to a bending line assumed by a beam fixedly fastened at one end thereof, when a load distributed over the length of the beam is applied thereto.

6. The sheet gripper according to claim 1, wherein said contact surface is formed by a plurality of rails.

7. The sheet gripper according to claim 6, wherein said rails are disposed in parallel.

8. The sheet gripper according to claim 1, wherein the gripper element is disposed in a cylinder gap formed in a sheet-transport cylinder of the sheet-fed rotary printing press.

9. A sheet gripper in a sheet-fed rotary printing press, having a pivotally supported gripper shaft, whereon a gripper element cooperatable with a gripper pad is pivotally disposed and a clamping element is fixedly disposed, comprising:

a spring element for placing the gripper element and the clamping element into operative contact, said spring element being formed as a leaf spring;

a fixed fastener disposed at one end of said leaf spring;

a gripper housing for the gripper element, the other end of said leaf spring located distal from said fixed fastener being connected to said gripper housing; and an adjusting device for adjusting a spaced distance between the gripper element and the gripper pad, said adjusting device being disposed between said other end of said leaf spring and said gripper housing.

10. The sheet gripper according to claim 2, including a compression spring disposed between an abutment of said gripper housing and an abutment of said clamping element.

11. The sheet gripper according to claim 10, wherein said compression spring is slightly prestressed for eliminating bearing play between said gripper housing and the gripper shaft.

* * * * *